US008183478B2

(12) United States Patent
Lamers et al.

(10) Patent No.: US 8,183,478 B2
(45) Date of Patent: May 22, 2012

(54) KEY ASSEMBLY FOR AN ELECTRONIC DEVICE HAVING A CONNECTED KEYCAP

(75) Inventors: Ramon Lamers, Duisburg (DE); Timothy Kyowski, Kitchener, CA (US)

(73) Assignee: Research In Motion Limited, Waterloo (CA)

( * ) Notice: Subject to any disclaimer, the term of this patent is extended or adjusted under 35 U.S.C. 154(b) by 394 days.

(21) Appl. No.: 12/605,535

(22) Filed: Oct. 26, 2009

(65) Prior Publication Data

US 2011/0094868 A1 Apr. 28, 2011

(51) Int. Cl.
*H01H 13/70* (2006.01)

(52) U.S. Cl. ..... 200/5 A; 200/512; 200/516; 200/517; 200/341

(58) Field of Classification Search ..... 200/5 A, 200/511, 512, 516, 517, 341; 341/22; 345/168–170; 400/472, 473, 485–496
See application file for complete search history.

(56) References Cited

U.S. PATENT DOCUMENTS

| | | | | |
|---|---|---|---|---|
| 3,826,885 | A * | 7/1974 | Allen et al. | 200/534 |
| 4,323,740 | A * | 4/1982 | Balash | 200/5 A |
| 4,400,593 | A | 8/1983 | Kunz | |
| 4,531,033 | A | 7/1985 | Schmid | |
| 5,448,026 | A | 9/1995 | Ozeki et al. | |
| 5,481,263 | A * | 1/1996 | Choi | 341/20 |
| 5,861,588 | A | 1/1999 | Gillot | |
| 6,864,881 | B2 * | 3/2005 | Lee | 345/168 |
| 7,041,924 | B2 * | 5/2006 | Jeschke et al. | 200/302.2 |
| 7,070,349 | B2 | 7/2006 | Dombrowski et al. | |
| 7,164,088 | B1 * | 1/2007 | Yurochko et al. | 200/5 A |
| 7,259,339 | B1 | 8/2007 | Babella | |
| 7,360,957 | B2 | 4/2008 | Dombrowski et al. | |
| 7,504,967 | B2 * | 3/2009 | Griffin | 341/22 |
| 7,579,561 | B2 * | 8/2009 | Wee et al. | 200/5 A |
| 7,864,513 | B2 * | 1/2011 | Chen | 361/679.08 |
| 7,928,963 | B2 * | 4/2011 | Chang et al. | 345/169 |
| 7,982,715 | B2 * | 7/2011 | Lawton et al. | 345/168 |

(Continued)

FOREIGN PATENT DOCUMENTS

| | | |
|---|---|---|
| EP | 1262861 A1 | 12/2002 |
| EP | 1585153 A1 | 10/2005 |

OTHER PUBLICATIONS

Non-Published U.S. Appl. No. 12/393,153, filed Feb. 26, 2009, Chen, Chao et al.

(Continued)

*Primary Examiner* — Michael Friedhofer
(74) *Attorney, Agent, or Firm* — Novak Druce + Quigg LLP

(57) ABSTRACT

The present application provides a key assembly for use in an electronic device. The key assembly comprises a plurality of dome switches and one or more single-piece keycaps. Each keycap has a plurality of key portions separated by deforming portions. The key assembly further comprises a plurality of actuators for activating the dome switches. Each actuator has a stem portion and an enlarged rigid blocking portion. The key assembly also comprises one or more rigid blocking members disposed between the blocking portion of the actuators and the keycaps and in close proximity to the blocking portion of the actuators. The blocking members form a barrier to limit a rotational movement of the actuators away from the dome switches.

20 Claims, 7 Drawing Sheets

U.S. PATENT DOCUMENTS

| | | | | |
|---|---|---|---|---|
| 2003/0201983 | A1 | 10/2003 | Jokinen | |
| 2005/0281605 | A1 | 12/2005 | Dombrowski et al. | |
| 2007/0120826 | A1 | 5/2007 | Burnette et al. | |
| 2007/0209913 | A1 * | 9/2007 | Clegg et al. | 200/5 A |
| 2008/0060928 | A1 | 3/2008 | Babella | |
| 2009/0107816 | A1 * | 4/2009 | Chen et al. | 200/314 |

OTHER PUBLICATIONS

Non-Published U.S. Appl. No. 12/567,926, filed Sep. 28, 2009, Chen, Chao et al.

EESR; European Patent App. No. 09174069.6; mailed Mar. 10, 2010.

* cited by examiner

KEY ASSEMBLY FOR AN ELECTRONIC DEVICE HAVING A CONNECTED KEYCAP

TECHNICAL FIELD

The present disclosure relates generally to input devices, and more particularly to key assemblies for handheld electronic devices.

BACKGROUND

Keypad and keyboard designs in handheld electronic devices attempt to balance several design constraints which often include the ability to provide illuminated keys, a visual separation between keys, a tactile separation between keys, tactile feedback to device users in response to a key press, and providing such features within a relatively thin device profile.

Modern keypad and keyboard designs often utilize dome switches rather than mechanical "hard closing" switches to provide a thinner device profile. Depending on the keypad or keyboard design which is used, the use of dome switches may result in keys which are wobbly and unstable, and more prone to damage.

BRIEF DESCRIPTION OF THE DRAWINGS

Like reference numerals are used in the drawings to denote like elements and features.

DETAILED DESCRIPTION OF EXAMPLE EMBODIMENTS

Figure 1:
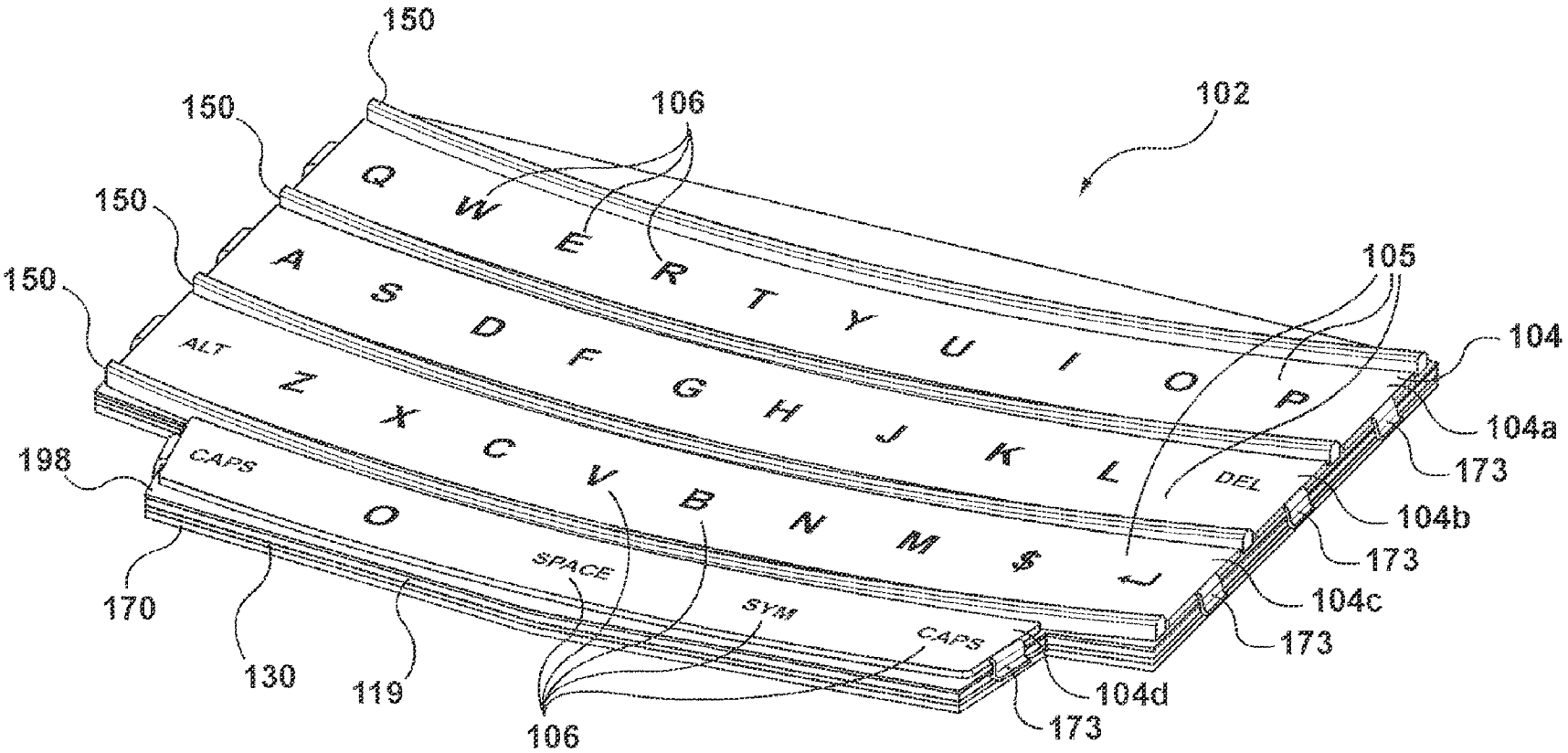
FIG. 1 is a perspective view of a key assembly in accordance with one example embodiment of the present disclosure.
Figure 2:
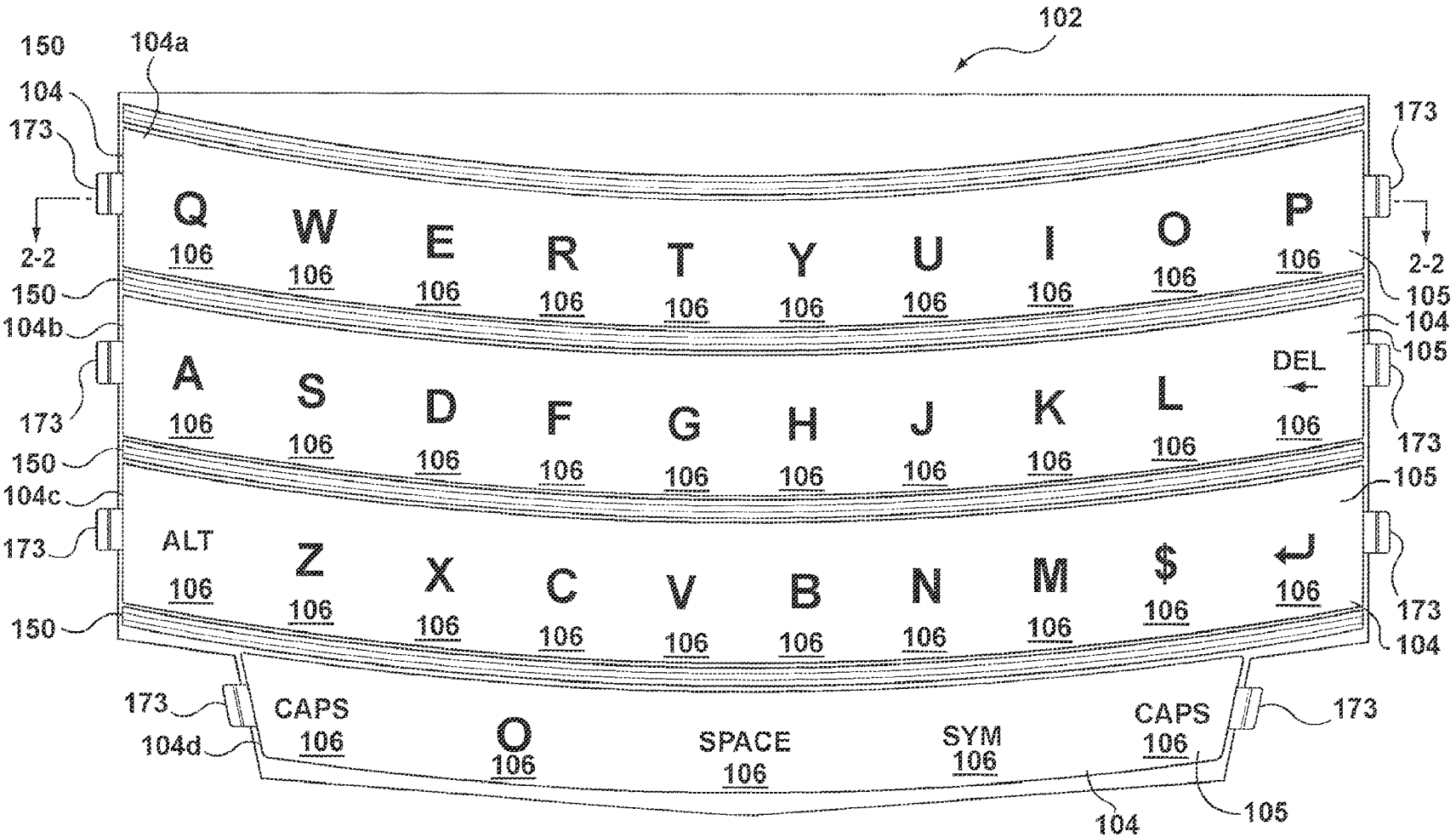
FIG. 2 is a top view of the key assembly of FIG. 1.
Figure 3:
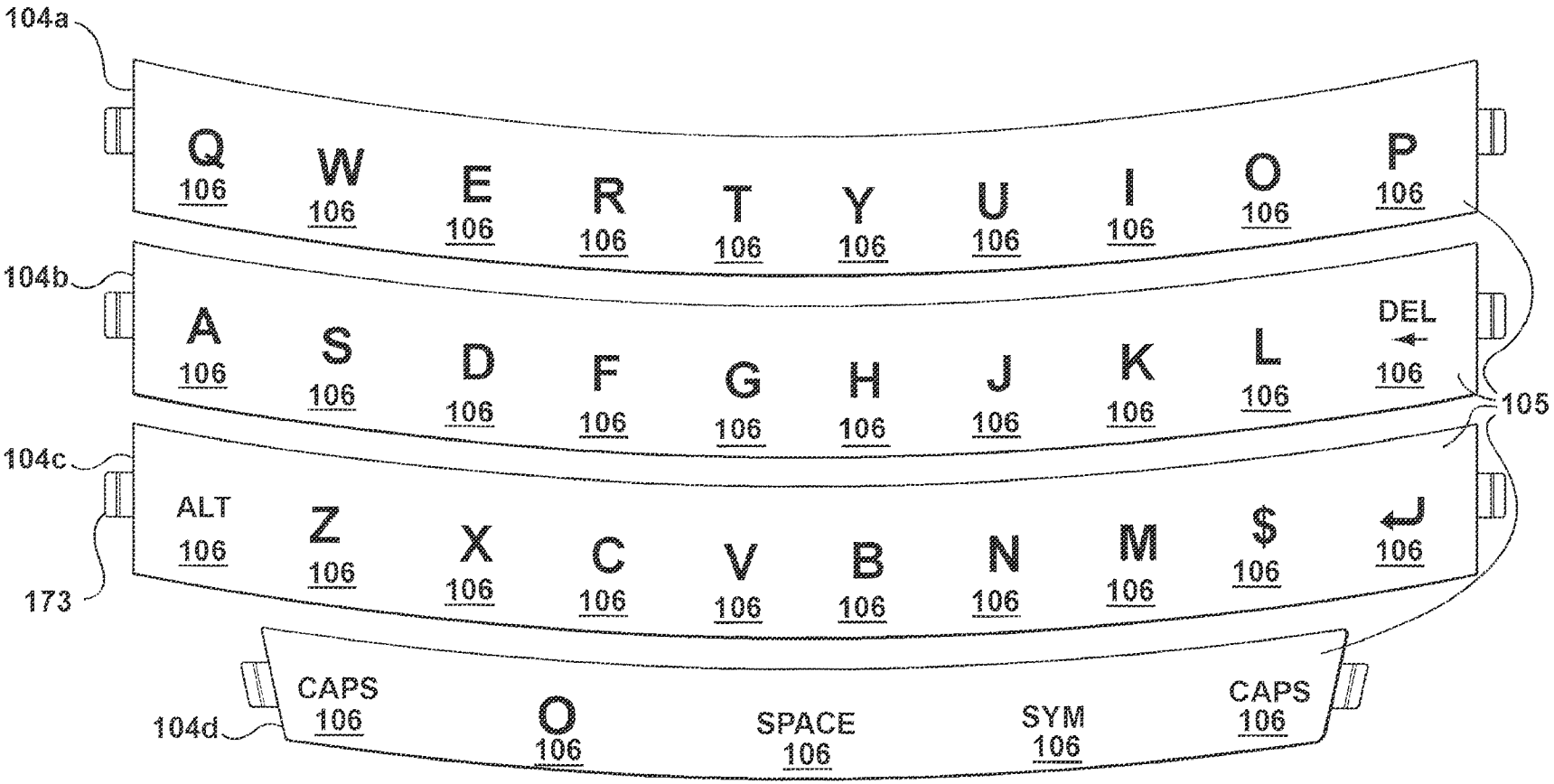
FIG. 3 is a top view of keycaps for use in the key assembly of FIG. 1 showing an externally facing side of the keycaps.

The present disclosure provides a key assembly for use in an electronic device. The key assembly comprises a plurality of dome switches. The key assembly further comprises one or more single-piece keycaps. Each keycap has a plurality of key portions separated by deforming portions. Each key portion is associated with a separate one of the plurality of dome switches. The key assembly further comprises a plurality of actuators for activating the dome switches. Each actuator has a stem portion and an enlarged rigid blocking portion. The blocking portion is oriented on a side of the actuator which is proximate the dome switches and the stem portion is oriented on a side of the actuator which is proximate the keycaps. The key assembly further comprises one or more rigid blocking members disposed between the blocking portion of the actuators and the keycaps and in close proximity to the blocking portion of the actuators. The one or more blocking members receive the stem portion of the one or more actuators. The blocking members form a barrier to limit a rotational movement of the actuators away from the dome switches.

In another aspect, the present disclosure provides an electronic device. The electronic device comprises a controller for controlling the operation of the device and a key assembly. The key assembly comprises a plurality of dome switches. The key assembly further comprises one or more single-piece keycaps. Each keycap has a plurality of key portions separated by deforming portions. Each key portion is associated with a separate one of the plurality of dome switches. The key assembly further comprises a plurality of actuators for activating the dome switches. Each actuator has a stem portion and an enlarged rigid blocking portion. The blocking portion is oriented on a side of the actuator which is proximate the dome switches and the stem portion is oriented on a side of the actuator which is proximate the keycaps. The key assembly further comprises one or more rigid blocking members disposed between the blocking portion of the actuators and the keycaps and in close proximity to the blocking portion of the actuators. The one or more blocking members receive the stem portion of the one or more actuators. The blocking members form a barrier to limit a rotational movement of the actuators away from the dome switches.

The teachings of the present disclosure relate generally to portable electronic devices such as mobile (e.g., wireless) communication devices such as pagers, cellular phones, Global Positioning System (GPS) navigation devices and other satellite navigation devices, smartphones, wireless organizers and wireless personal digital assistants (PDA). The portable electronic devices could be a device without wireless communication capabilities such as a PDA, electronic gaming device, digital photograph album or picture frame, digital camera, or digital video recorder such as a camcorder. The portable electronic device may comprise a touchscreen display as well as a keypad. These examples are intended to be non-limiting. It is also possible that the teachings of the present disclosure could be applied to electronic devices other than handheld electronic devices such as notebook computers.

Reference is first made to FIGS. 1 to 9 which illustrate a key assembly 102 for use in an electronic device in accordance with one embodiment of the present disclosure. In FIGS. 1 to 9, example features have been illustrated by reference numerals. In some figures, where there are multiple instances of the same feature, in order to enhance the readability of the figures, only a subset of these features have been numbered. For example, in FIGS. 4 and 5, there exists a plurality of actuators 140. In order to increase the readability of this drawing, only two such actuators 140 have been labelled.

The key assembly 102 comprises a plurality of single-piece keycaps 104 formed of a rigid material. In the embodiment shown, each keycap 104 is associated with and identifies a complete row of keyboard characters. The keyboard may be a QWERTY, QWERTZ, AZERTY, or Dvorak keyboard. In some embodiments, the key assembly 102 described herein may be used for other non-keyboard types of keys. For example, the key assembly 102 may identify function keys associated with a host electronic device.

By way of example, in embodiments in which the keycap 104 represents characters of a keyboard and where the keyboard is a QWERTY keyboard, a first keycap 104*a* (FIG. 1) may be associated with and identify the complete row of keyboard characters which includes the characters: 'Q', 'W', 'E', 'R', 'T', 'Y', 'U', 'I', 'O', and 'P'. Similarly, a second keycap 104*b* (FIG. 1) may be associated with and identify the complete row of keyboard characters which includes the characters: 'A', 'S', 'D', 'F', 'G', 'H', 'J', 'K', and 'L'. A third keycap 104*c* (FIG. 1) may be associated with and identify the complete row of keyboard characters which includes the characters: 'Z', 'X', 'C', 'V', 'B', 'N', 'M', and, in some embodiments '$'. A fourth keycap 104*d* may be associated with and identify the space character. In the embodiment shown, the fourth keycap 104*d* also identifies the zero ('0') character.

The characters associated with the keycaps 104 include letters that are used to write in a given language. For example, the characters may include letters of the English alphabet. In some embodiments, the characters are an alphanumeric character set that includes letters and numbers.

The characters associated with the keycaps 104 may be identified on the keycaps 104 in a number of ways. For example, in some embodiments, the characters are identified by a visual identifier such as in-mould labelling ("IML") of the keycap 104. In other embodiments, the characters are identified by in-mould decoration ("IMD") of the keycap 104. It will, however, be appreciated that other suitable labelling techniques may also be used to identify the characters associated with the keycap 104.

Each keycap has a plurality of key portions 106 aligned in a single row along the keycap 104. In some embodiments, each key portion 106 is associated with and identifies at least one keyboard character or function key. In some embodiments, each key portion 106 which identifies a keyboard character is associated with and identifies a single keyboard character. In other embodiments, a single key portion 106 may be associated with multiple characters. For example, in some embodiments, a key portion 106 may be associated with two characters. For example, a first key portion 106 may be associated with the 'Q' and 'W' characters, a second key portion 106 associated with the 'E' and 'R', and so on. In such embodiments, the handheld electronic device in which the key assembly 102 is used may have a predictive text engine. In response to the depression of a key portion 106, the predictive text engine may be used to predict a desired character from the plurality of characters associated with that key portion 106.

As noted previously, in at least some embodiments, the keycaps 104 may include one or more key portions 106 which are associated with specific functions of the host electronic device in which the key assembly 102 operates. These functions may be defined by software associated with the host electronic device. For example, in the embodiment of FIGS. 1 to 9, the second keycap 104*b* identifies and is associated with the delete function (See, for example, FIG. 1). When the delete function is activated, a most-recently input character may be deleted.

By way of further example, in the shown embodiment, the third keycap 104*c* identifies and is associated with an 'Alt' or alternative function and a Return function. The alternative function may be used to invoke an alternative character or function associated with one of the key portions 106 of the keycaps 104. The Return function may be used to input a carriage return.

In the shown embodiment, the fourth keycap 104*d* identifies and is associated with a 'Caps' function and a 'Sym' or symbol function. The 'Caps' function may be used to capitalize a character on one of the keycaps 104. The symbol function may be an additional character function which permits a user to input non standard characters. In some embodiments, when the additional-character function is activated, a display screen associated with the host electronic device displays a plurality of non-standard characters. The non-standard characters are characters which may not have a specific reserved key portion 106 associated therewith. For example, the non-standard characters may include the '@', or '%' characters. When the non-standard characters are displayed on the display screen, a user may select one of the non-standard characters by interacting with an input mechanism associated with the host electronic device. It will be appreciated that other functions may be associated with and identified on one or more of the key portions 106 of the keycaps 104.

The keycaps 104, in at least some embodiments, have an externally facing side 105. In the embodiment shown the externally facing side 105 is a smooth side, having no spaces or gaps across its length.

In other embodiments (not shown), the externally facing side 105 may have visual and/or tactile features disposed thereon. These tactile features may, in some embodiments, include an externally protruding portion or an indentation for assisting the user in navigating the key assembly 102. The tactile features may provide tactile feedback to a user to assist that user in locating a desired key portion 106. That is, the tactile features may be used to assist a user in determining the boundaries of a key portion 106.

Each keycap 104 also includes a plurality of deforming portions 108 (FIGS. 4-6) which separate adjacent key portions 106. In the shown embodiment of FIGS. 1 to 9, each key portion 106 is separated by respective mechanically deforming portions 108. The deforming portions 108 act as a hinge to permit key portions 106 to swing or otherwise move relative to an adjacent key portion 106.

In some embodiments, the deforming portions 108 (which may be seen in FIGS. 4, 5, and 6) of the keycap 104 have a cross section 111 (FIG. 6) that is thinner than a cross section 113 (FIG. 6) of the key portions 106 of the keycap 104. In such embodiments, the mechanically deforming portions 108 may be defined by grooves in the keycap. In some embodiments, the grooves may be formed on one side of the keycap 104. In other embodiments, the grooves may be formed on opposed sides of the keycap 104. In some embodiments, the mechanically deforming portions 108 have a cross section 111 (FIG. 6) that is approximately 0.25 mm in thickness, although other thicknesses may be suitable to fit the application.

In some embodiments, the grooves may be provided on the externally facing side 105 of the keycap 104 to provide the dual functions of mechanical deformation to allow for key presses of the respective key portions 106 of the keycap 104, and visual or tactile separation between key portions 106 of the keycap 104 for key identification by device users.

In other embodiments, the grooves are provided on an internally facing side 107 (FIG. 5) of the keycap 104 to provide mechanical deformation to allow for key presses of the respective key portions 106 of the keycap 104.

In some embodiments where the grooves are provided on the internally facing side 107, the externally facing side 105 does not have grooves to define the limits of the key portions 106 of the keycap 104. In such embodiments, the externally facing side 105 of the deforming portion 108 of the keycap 104 may have a surface which is level and/or continuous with the surface of the externally facing side 105 of the key portion which is adjacent to that deforming portion 108. That is, the externally facing side 105 may have no grooves at the deforming portion 108. In such embodiments, the externally facing side 105 may have no sharp transitions in gradient. Avoiding such sharp gradient transitions on the externally facing side 105 (such as grooves) may, in some embodiments, be used to prevent the accumulation of debris in the key assembly 102.

In embodiments where the externally facing side 105 does not have grooves, visual and/or tactile indications of the individual key portions 106 of the keycap 104 may be provided by other means; for example, through the use of other tactile features on the key portions 106 of the keycap 104 as described above.

The key portions 106 and the deforming portions 108 of the keycap 104 are formed of a common material. In some embodiments, the key portions 106 and the deforming portions 108 are formed of a rigid plastic, such as a polycarbonate, although it is appreciated that other materials with similar properties may be appropriate.

Figure 4:
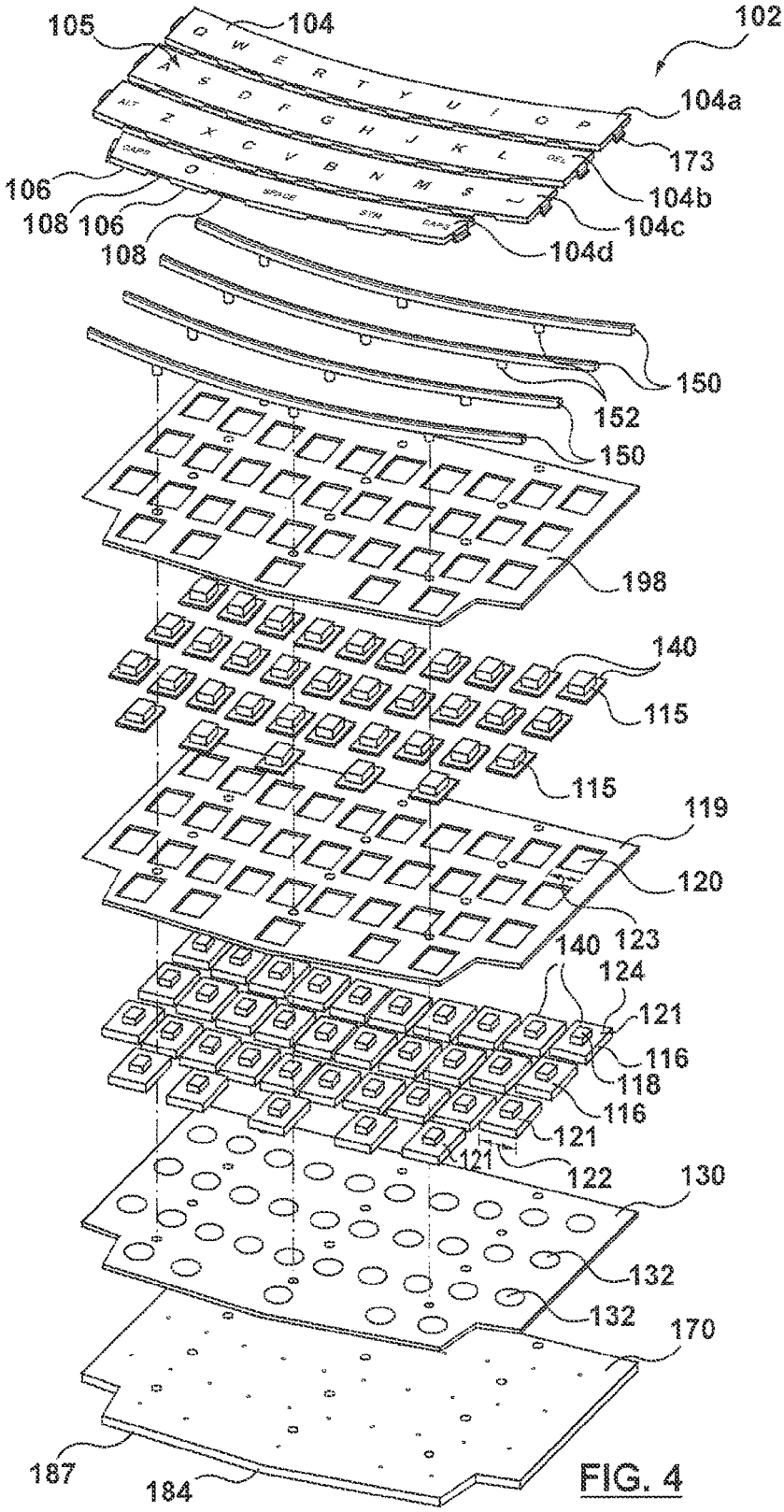
FIG. 4 is an exploded top perspective view of the key assembly of FIG. 1.
Figure 5:
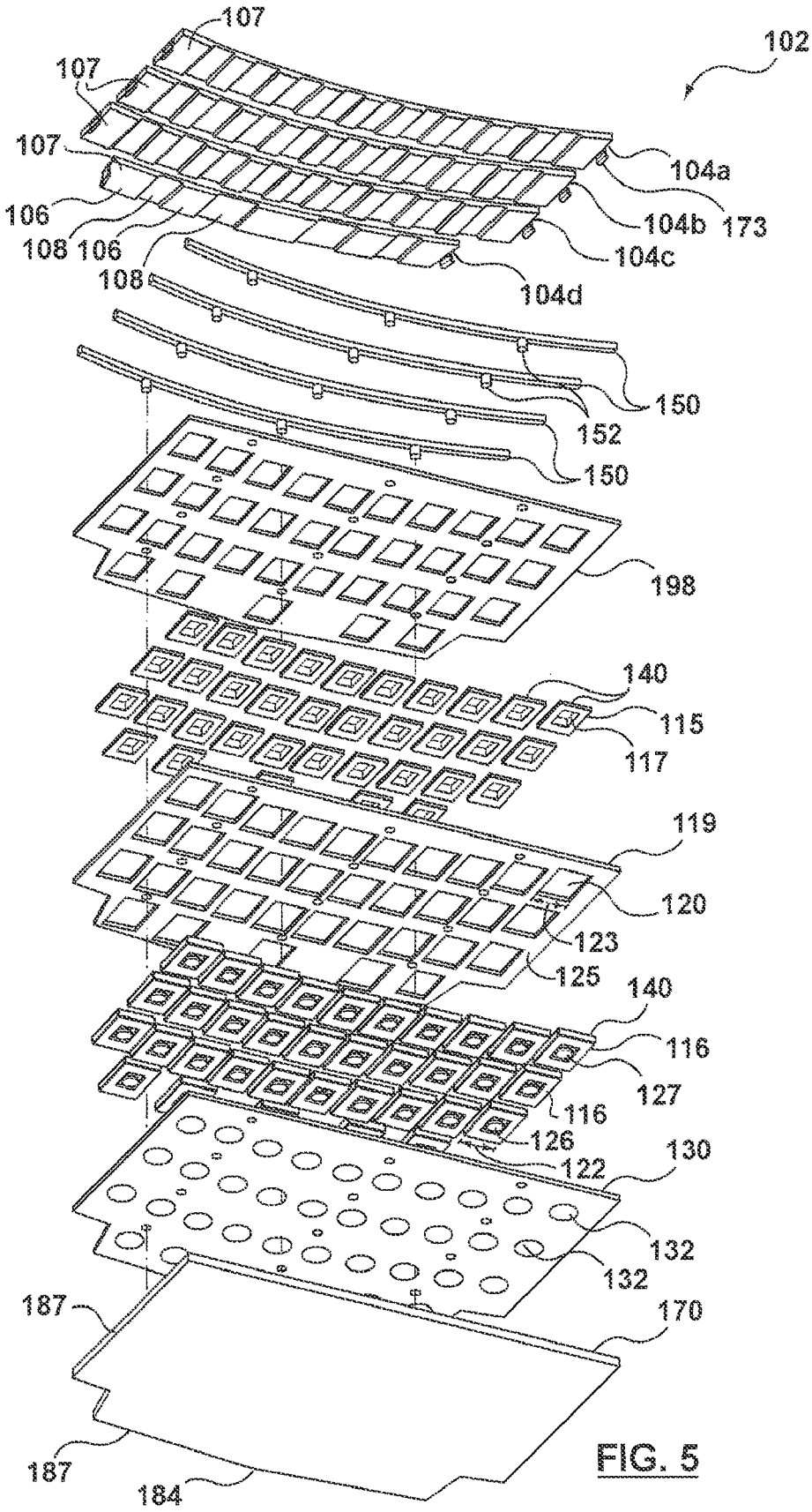
FIG. 5 is an exploded bottom perspective view of the key assembly of FIG. 1.
Figure 6:
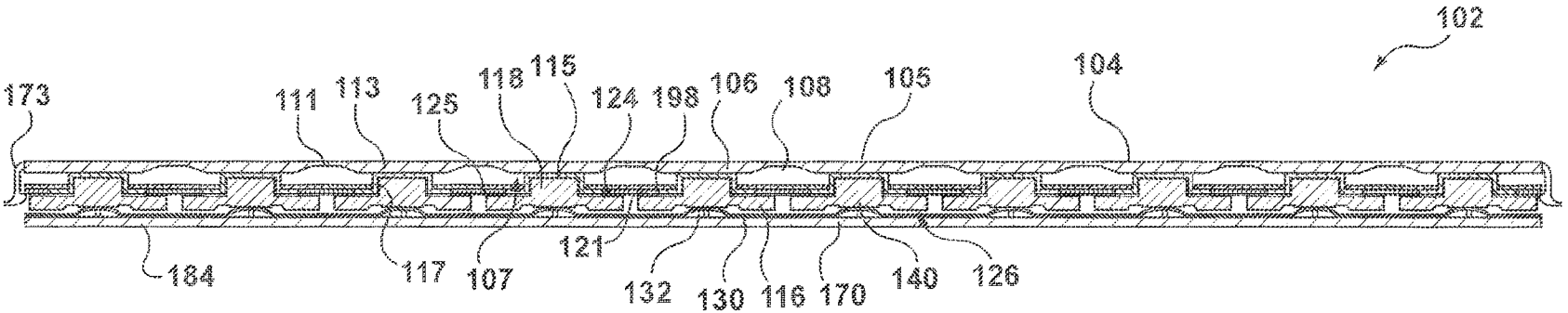
FIG. 6 is a sectional view of the key assembly of FIG. 1 taken along the line 2-2 of FIG. 2.

The key assembly 102 also includes a plurality of dome switches 132. Each key portion of the keycap 104 is associated with a separate one of the dome switches 132 (FIGS. 4, 5 and 6). The dome switches 132 may be included on a dome sheet 130 which mechanically connects the dome switches 132 together to provide stability to the dome switches 132 and to hold the dome switches 132 in place within the key assembly 102.

In some embodiments, each dome switch 132 comprises a polyethylene terephthalate (PET) film which overlays a collapsible metal dome having a nickel plating over a gold plating on a flexible printed circuit board (PCB). As will be explained in greater detail below, when a key portion 106 is pressed, the dome of the respective dome switch 132 collapses, thereby connecting conductive platings on an adjacent printed circuit board ("PCB") 170 (FIGS. 4, 5 and 6) and completing a connection therebetween. The PCB 170 includes an electrical connector (not shown) which may be used to connect the PCB 170 to a controller of a host electronic device. The electrical connector may, in some embodiments, be a ribbon connector. The controller of the host electronic device receives an input signal in response to the connection of the conductive platings caused by actuation of the dome switch 132. The controller recognizes a corresponding input in response to the received input signal. In other embodiments, other dome switch constructions could be used.

In some embodiments, the dome sheet 130 may act as a light guide to permit light generated on one side of the dome sheet 130 to travel to another side of the dome sheet 130. In such embodiments, the dome sheet 130 may be constructed, at least in part, of a material that is transparent or, in some embodiments, translucent. For example, the dome sheet 130 may have portions which are constructed of a clear plastic and/or silicone.

The key assembly 102 further comprises a plurality of actuators 140 (FIGS. 4, 5, 6) for activating the dome switches 132. Each actuator 140 actuates a different one of the dome switches 132. Each actuator 140 is associated with a different one of the key portions 106. In the embodiment shown, each key portion 106 is associated with a single actuator 140. The actuator 140 has a first side which engages the associated key portion 106 and a second side which engages a dome switch 132. In some embodiments, the actuator 140 directly engages its associated key portion 106; for example through direct contact. In other embodiments, the key assembly 102 may include a further layer (not shown) between the actuator 140 and the key portions 106 and the key portion 106 engages the actuator 140 through this further layer. The actuator 140 engages the associated key portion 106 in that a force applied to the externally facing side 105 of the key portion 106 is transferred, in whole or in part, to the actuator 140.

In some embodiments, the first side of the actuator 140 is proportionally shaped to the internally facing side 107 of the associated key portion 106 in order to provide proper support. The keycap 104 may, in some embodiments, be connected to the first side of the actuators 140 using an adhesive.

The actuators 140 each include a movable portion 115 which permits the actuators 140 to move towards and away from the dome switches 132 to close or open the dome switches 132 in response to a force being applied to the externally facing side 105 of the key portion 106 of the keycap 104. The movable portion 115 is constructed of a malleable material, such as silicone. In some embodiments (not shown), the movable portions 115 of adjacent actuators 140 are connected together in order to provide stability to the actuators 140. The movable portions 115 may be connected together along a row of the key assembly 102. That is, each movable portion 115 may be connected to the movable portion 115 of an adjacent actuator 140. In some embodiments, the movable portions 115 for all of the actuators 140 may be connected together. In such embodiments, each movable portion 115 may be connected to each adjacent movable portion, thus forming an actuator sheet. In other embodiments, such as the embodiment illustrated in FIGS. 1 to 9, the movable portions 115 are not connected together.

In some embodiments, the actuators 140 may also act as a light guide to permit light generated on one side of the actuators 140 to travel to another side of the actuators 140. For example, in some embodiments, the key assembly includes the PCB 170 which includes one or more light generating elements, such as a light emitting diode ("LED"). The light passes through holes defined by the dome sheet 130 (or through the dome sheet 130 itself if the dome sheet 130 serves the dual role of an integrated dome sheet and light guide) and the light is then passed by the actuators 140 to the keycaps 104, thus allowing the keycaps 104 to be illuminated.

Where the actuators 140 act as a light guide, the actuators 140 may be constructed of a material that is transparent or, in some embodiments, translucent. For example, the actuators 140 may be constructed of a clear plastic and/or silicone.

The actuators 140 may also have a blocking portion 116 (See, for example, FIGS. 4, 5, 6). The blocking portion 116 is formed of a rigid material. For example, in some embodiments, the blocking portion 116 may be comprised of a rigid plastic, which may be formed, for example, by plastic injection. That is, the blocking portion 116 of the actuators 140 may be formed of a rigid polycarbonate using injection moulding.

The actuator 140 is oriented in the key assembly 102 in such a way that the blocking portion 116 of the actuator 140 is proximate the dome switches 132 and a stem portion 118 (FIG. 7) is proximate the keycaps 104. That is, the blocking portion 116 is oriented in close proximity to the dome switches and the stem portion 118 is oriented in close proximity to the keycaps 104. The stem portion 118 is connected at one end, either directly or indirectly, to the keycap 104. In the embodiment shown, the stem portion 118 is indirectly connected to the keycap 104. That is, the stem portion 118 is connected to the movable portion 115 which is connected to the keycap 104. In other embodiments, the stem portion 118 may be connected directly to the keycap 104.

The blocking portion 116 may be attached to the movable portion 115 in a number of ways. By way of example, in some embodiments, the blocking portion 116 may be co-moulded with the movable portion 115 of the actuators 140. In other embodiments, the blocking portion 116 may be attached to the movable portion 115 using an adhesive. Other methods of connecting the blocking portion 116 to the movable portion 115 are also possible.

Figure 9:
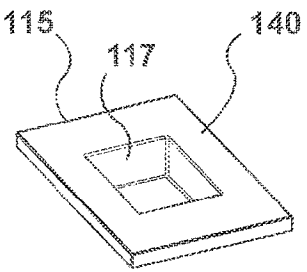
FIG. 9 is a bottom perspective view of a movable portion of an actuator for use in the key assembly of FIG. 1.
Figure 8:
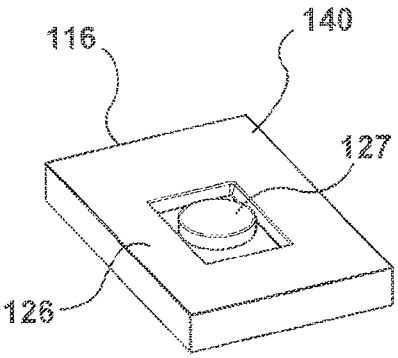
FIG. 8 is a bottom perspective view of the blocking portion of the actuator for use in the key assembly of FIG. 1.
Figure 7:
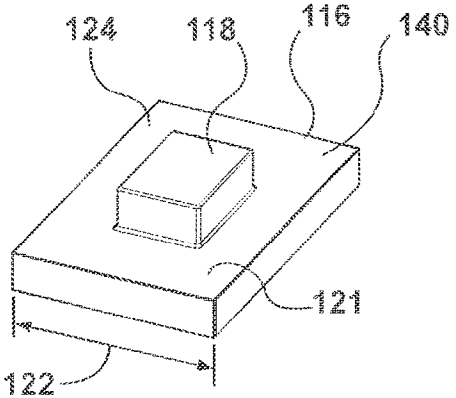
FIG. 7 is a top perspective view of a blocking portion of an actuator for use in the key assembly of FIG. 1.

As illustrated in FIGS. 7 and 9, in some embodiments, the movable portion 115 (FIG. 9) may define a recess 117 in which the stem portion 118 (FIG. 7) of the actuator 140 may be received. Although other materials with similar properties may be suitable, the stem portion 118 is constructed of the same rigid material as the blocking portion 116 and extends upwardly, away from the dome switches 132 from the center of the blocking portion 116. The recess 117 of the movable portion 115 of the actuator 140 and the stem portion 118 may be correspondingly sized so that the stem portion 118 fits tightly within the recess 117 of the movable portion 115. This stem portion 118 serves to give further stability to the movable portion 115.

Referring now to FIGS. 4 and 5, the key assembly 102 further includes one or more blocking members 119. In the embodiments shown, the blocking member 119 is a flat sheet. The blocking member 119 is disposed within the key assembly 102 at a layer which is between the blocking portions 116 of the actuators 140 and the keycaps 104. The blocking member 119 is located in close proximity to the blocking portions 116 of the actuators 140.

The blocking members 119 define one or more openings 120 which receive the actuators 140. Each actuator 140 is received in a different one of the openings 120 of the blocking members 119. In the embodiment shown, the openings 120 are rectangular in shape. The openings 120 have a shape that corresponds to the shape of the stem portion 118 of the actuator 140 which moves therethrough. The blocking member 119 is comprised of a rigid material such as, for example a metal. The stem portion 118 is narrower than the enlarged rigid blocking portion 116 of the actuator 140 and is received by and protrudes through the opening 120 of the blocking members 119.

When the key assembly 102 is assembled, the blocking member 119 is sandwiched within the actuators 140. The blocking portions 116 of the actuators 140 each have a first side 121 which is larger, in at least one dimension, than the opening 120 of the blocking member 119. That is, the first side 121 of the blocking portions 116 of the actuators 140 has a length 122 which is larger than a length 123 of the opening 120. The length 122, 123 is the dimension of the first side 121 of the actuators or opening 120 that is in the same direction as the length of the elongate keycap 104.

In some embodiments, the blocking member 119 may be co-moulded with the movable portion 115 of the actuator 140. For example, the openings 120 in the blocking member 119 may have the movable portion 115 disposed therein. Thus, the blocking member 119 may support the movable portion 115. Such support may be provided by connecting the movable portion to the blocking member 119; for example, through co-moulding or an adhesive.

The movable portion 115 of the actuator 140 is constructed of a movable, stretchable, or otherwise deformable material. That is, the movable portion 115 of the actuator 140 is constructed of a material which allows for the movement of the actuators 140 in order to depress their associated dome switches 132. The movable portion 115 of the actuator 140 serves to provide additional stability to the key assembly. It will, however, be appreciated that, in at least some embodiments, the actuators 140 do not contain the movable portions 115. In such embodiments, the stem 118 of the actuators 140 may directly contact the key portions 106.

The first side 121 of the blocking portion 116 has a blocking surface 124. When no external forces are applied to the keycap 102 (for example, by a user), the blocking surface 124 is disposed in close proximity to an interior side 125 (FIG. 5) of the blocking member 119. When the key assembly 102 is assembled, the blocking portion 116 extends underneath the blocking member 119 on each side of the opening 120, so that the blocking surface 124 is in close proximity to the interior side 125 of the blocking member.

When a balanced (or even) force is applied to the key portion 106 associated with the actuator 140, the actuator 140 is moved towards its associated dome switch 132. More particularly, the movable portion 115 of the actuator 140 permits the actuator 140 to move towards its associated dome switch 132. A balanced (or even) force is a force which is balanced, or substantially balanced across the center of the key portion 106.

An unbalanced (or uneven) force is a force which is not balanced across the center of the key portion 106. For example, an unbalanced force may occur when a force is applied to a single end of the key portion 106. This may occur, for example, when an adjacent key portion 106 contained on the same keycap 104 is depressed. Since the keycap 104 is rigid, a force applied to one of the key portions 106 creates an unbalanced force on adjacent key portions 106. Ordinarily, in embodiments without blocking features, this blocking force would cause the side of an adjacent key portion 106 which is furthest from the applied force to move upwardly away from the dome switches 132. By way of example, in a QWERTY keyboard such as the keyboard shown in FIG. 1, an application of force to the 'Q' key portion 106 causes an unbalanced force on the adjacent 'W' key portion 106. This unbalanced force causes the 'W' key portion 106 to attempt to rotate. More particularly, without blocking features, the side of the 'W' key portion 106 which is farthest from the 'Q' key portion 106 may become raised.

In some embodiments, the blocking portion 116 of the actuator 140 interferes with the blocking member 119 to prevent the upward movement of a key portion 106 due to the application of a force to an adjacent key portion 106. That is, the blocking member 119, together with the blocking portion 116 of the actuators 140, helps to prevent or reduce key twisting and upward movement of a key portion 106 due to the application of an unbalanced force to that key portion 106. When an unbalanced force is applied to a key portion 106 (for example, due to the depression of an adjacent key portion 106), the actuator 140 also experiences an unbalanced force. This unbalanced force is a torque which causes the actuator 140 to attempt to rotate. When this happens, an end of the blocking surface 124 of the blocking portion 116 interferes with the interior side 125 (FIG. 5) of the blocking member 119. The end of the blocking surface 124 that interferes with the interior side 125 of the blocking member 119 will be the end that is opposite the end of the actuator 140 on which the force is applied. This interference prevents the upward movement of the actuator 140. That is, the blocking members 119 form a barrier to limit the rotational movement of the actuators away from the dome switches.

The blocking portion 116 of the actuators 140 may have an interior side 126 (FIG. 5, 8) which contacts the dome switches 132, either directly or indirectly. The interior side 126 may, in some embodiments include a dome contact area 127 which may be shaped and sized for contacting the dome switches 132. In the embodiment illustrated, the dome contact area 127 is a circular area. Shaping and sizing the dome contact area 127 for contacting the dome switches 132 may be useful to prevent the actuator 140 from inadvertently contacting other features in the key assembly 102 when the actuator 140 is depressed. However, it will be appreciated that in some embodiments the dome contact area 127 may not be correspondingly shaped or sized.

Figure 10:
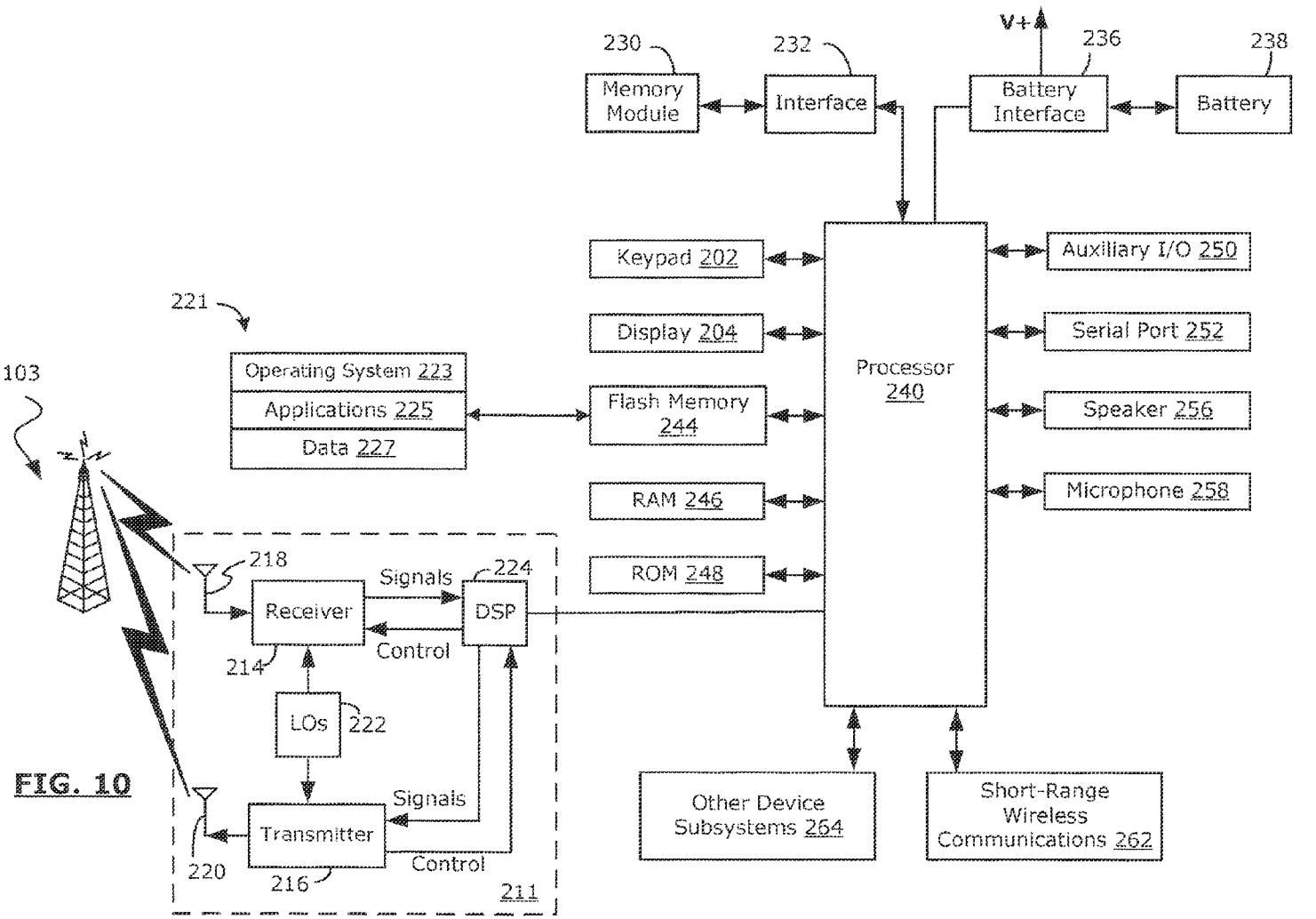
FIG. 10 is a block diagram illustrating a handheld electronic device in accordance with one example embodiment of the present disclosure.

In some embodiments, at least some of the key portions 106 have a transparent portion or window for transmitting light from the light generating elements therethrough. In some embodiments, each of the key portions 106 have a transparent portion for transmitting light therethrough to provide backlighting of the key portions. In at least some embodiments, the keycap 104 is formed of a rigid polycarbonate. In some embodiments, the keycap 104 is formed of a transparent material such as a light diffusing polycarbonate which is painted with a desired colour or colours and laser-etched to remove a portion of the paint and expose the transparent material for transmitting light therethrough. In some embodiments, the key portions 106 are painted a first colour which will provide the backlight colour and then painted a second colour which, for example, matches a colour of the housing of the host electronic device 201 (FIG. 10). The second colour is then laser-etched in predefined shapes to expose the first colour. The predefined shape may be used to provide a visual representation which informs the device user of a function of the respective key portions 106. The predefined shape is typically different for each key portion 106. The first colour may vary between key portions 106. When assembled into the host electronic device 201, activation of the LEDs on the PCB 170 backlights the respective key portions 106 so as to illuminate the laser-etched shape in the respective background colour (e.g., the first colour).

In the embodiment illustrated, the key assembly 102 also includes a light shield 198. The light shield 198 is an opaque layer which is disposed between the keycaps 104 and the actuators 140 and serves to prevent light from escaping in undesirable locations. That is, the light shield 198 focuses any light on the key portions 106 of the keycap 104.

The key assembly 102 may also include a back plate 184. The back plate 184 is disposed on the side of the dome sheet 132 that opposes the side on which the actuators 140 are located. The back plate 184 may be, but is not necessarily, located in a layer of the key assembly 102 which is adjacent to the PCB 170. An adhesive layer may be disposed between the PCB 170 and the back plate 184. The adhesive layer connects the PCB 170 to the back plate 184.

The back plate 184 includes an edge 187 which extends upwardly in the direction of the dome sheet 130. Thus, the back plate 184 acts as a housing for the dome sheet 130 and, in some embodiments, the actuators 140. Accordingly, the key assembly 102 may include a number of layers including, for example, one or more keycaps 104, a light shield 198, one or more actuator sheets which may be comprised of actuators 140, a blocking member 119, one or more dome sheets 130, a PCB 170 and a back plate 184. These layers may be connected in a variety of ways including, for example, adhesives, co-moulding, the use of physical connectors, or any combination thereof.

In some embodiments, at least some of the layers of the key assembly 102 may be connected to the key assembly 102 by way of one or more connectors or frets 150. In the embodiment shown, the connectors 150 are comprised of elongate bars which are disposed between adjacent keycaps 104. In the shown embodiment, the connectors 150 act as separating members to space adjacent keycaps 104. Such spacers may serve a number of functions including, for example, spacing the keycaps 104 in order to accommodate a user's fingers and prevent the accidental depression of an adjacent keycap. The connectors 150 may also serve to act as a visual separator of adjacent keycaps 104. In such cases, the connectors 150 may be a different colour than the keycaps 104. In the embodiment shown, the connectors 150 hold the blocking member 119 in spaced relation to the dome switches 132.

In the shown embodiment, the connectors 150 have one or more protrusions 152 thereon. The protrusions 152 extend downwardly, towards the dome sheet 132 and may be received by corresponding holes defined by the actuator sheet and, in some embodiments, corresponding holes defined in a light shield layer 198, the dome sheet 130, the PCB 170, and/or the back plate 184. It will be appreciated that some of these layers may not be included in some embodiments, or that other layers apart from those discussed herein may be included in some embodiments.

In some embodiments, the protrusion 152 on the connectors 150 may have an enlarged end which is larger than at least one of the holes through which the protrusion is received. Once the key assembly 102 is assembled, the enlarged end holds the protrusions 152 in the holes. That is, the enlarged ends prevent the protrusions 152 from escaping the holes.

In a further example regarding the connection of various layers to the key assembly 102, in some embodiments, the keycaps 104 may be connected to the key assembly 102 using an adhesive which bonds the keycaps 104 to their respective actuators 140. In some embodiments, the keycap 104 may include hook features 173 disposed at opposing ends of the keycap 102. These hook features 173 may be received by corresponding catch features (not shown) on the key assembly 102.

While the embodiment shown illustrates actuators that are not connected in an actuator sheet, in other embodiments, two or more actuators 140 may be connected together; for example, at the movable portions 115. Accordingly, the actuators 140 may be provided on an actuator sheet which includes a plurality of movable portions 115 which connect the actuators 140 together to provide stability and hold the actuators 140 in place within the key assembly 102. In some embodiments, the actuator sheet connects all of the actuators 140. It will be appreciated, however, that in other embodiments, the actuators 140 or a subset thereof may be connected in other ways. For example, in some embodiments, a plurality of actuator sheets may be used. In such embodiments, the actuator sheets may connect the actuators 140, for example, in a row-wise or column-wise manner. In embodiments in which row-wise connections are used, each actuator sheet may connect only the actuators 140 in a given row of the key assembly 102. That is, the actuators 140 which are associated with the key portions 106 on the first keycap 104*a* may be connected together, and actuators 140 which are associated with the key portions 106 on the second keycap 104*b* may be connected together in a second actuator sheet. Similarly, where column-wise connections are used, each actuator sheet may connect the actuators in a given column of the key assembly 102. Accordingly, in at least some embodiments, the number of actuator sheets may correspond to the number of keycaps 104.

The key assembly 102 typically includes a mounting sub-assembly (not shown) for mounting the key assembly 102 to the host electronic device, for example, the handheld electronic device 201 described below.

While portions of the key assembly 102 are shown as separate elements, some of these elements may be combined in other embodiments or formed together using co-moulding in other embodiments. For example, in some embodiments, the blocking portion 116 of the actuator may be co-moulded with the movable portion 115 of the actuators 140. It is also possible that some of the elements described as a single element may be implemented using multiple elements in other embodiments.

It will also be appreciated that, while the embodiment discussed herein discussed the use of dome switches, other switch types may also be used.

Reference is now made to FIG. 10 which illustrates the handheld electronic device 201 in which example embodiments described in the present disclosure can be applied. The handheld electronic device 201 is a two-way communication device having data and voice communication capabilities, and the capability to communicate with other computer systems, for example, via the Internet. Depending on the functionality provided by the handheld electronic device 201, in various embodiments the device 201 may be a multiple-mode communication device configured for both data and voice communication, a smartphone, a mobile telephone or a PDA (personal digital assistant) enabled for wireless communication, or a computer system with a wireless modem.

The handheld electronic device 201 includes a rigid case (not shown) housing the components of the device 201. The internal components of the device 201 are constructed on, or connected via, a printed circuit board (PCB) (which may be the PCB 170). The handheld electronic device 201 includes a controller comprising at least one processor 240 (such as a microprocessor) which controls the overall operation of the device 201. The processor 240 interacts with device subsystems such as a wireless communication subsystem 211 for exchanging radio frequency signals with a wireless network 103 to perform communication functions. The processor 240 interacts with additional device subsystems including a display (screen) 204 such as a liquid crystal display (LCD) screen, a keypad 202 constructed using a key assembly in accordance with the present disclosure such as the key assembly 102 of FIG. 1, possibly other input devices (not shown), flash memory 244, random access memory (RAM) 246, read only memory (ROM) 248, auxiliary input/output (I/O) subsystems 250, data port 252 such as serial data port, such as a Universal Serial Bus (USB) data port, speaker 256, microphone 258, short-range communication subsystem 262, and other device subsystems generally designated as 264. Some of the subsystems shown in FIG. 10 perform communication-related functions, whereas other subsystems may provide "resident" or on-device functions. The device 201 may comprise a touchscreen display in some embodiments. The touchscreen display may be constructed using a touch-sensitive input side connected to an electronic controller and which overlays the display screen 204. The touch-sensitive overlay and the electronic controller provide a touch-sensitive input device and the processor 240 interacts with the touch-sensitive overlay via the electronic controller.

The communication subsystem 211 includes a receiver 214, a transmitter 216, and associated components, such as one or more antenna elements 218 and 220, local oscillators (LOs) 222, and a processing module such as a digital signal processor (DSP) 224. The antenna elements 218 and 220 may be embedded or internal to the handheld electronic device 201 and a single antenna may be shared by both receiver and transmitter, as is known in the art. As will be apparent to those skilled in the field of communication, the particular design of the wireless communication subsystem 211 depends on the wireless network 103 in which handheld electronic device 201 is intended to operate.

The handheld electronic device 201 may communicate with any one of a plurality of fixed transceiver base stations of the wireless network 103 within its geographic coverage area. The handheld electronic device 201 may send and receive communication signals over the wireless network 103 after the required network registration or activation procedures have been completed. Signals received by the antenna 218 through the wireless network 103 are input to the receiver 214, which may perform such common receiver functions as signal amplification, frequency down conversion, filtering, channel selection, etc., as well as analog-to-digital (A/D) conversion. A/D conversion of a received signal allows more complex communication functions such as demodulation and decoding to be performed in the DSP 224. In a similar manner, signals to be transmitted are processed, including modulation and encoding, for example, by the DSP 224. These DSP-processed signals are input to the transmitter 216 for digital-to-analog (D/A) conversion, frequency up conversion, filtering, amplification, and transmission to the wireless network 103 via the antenna 220. The DSP 224 not only processes communication signals, but may also provide for receiver and transmitter control. For example, the gains applied to communication signals in the receiver 214 and the transmitter 216 may be adaptively controlled through automatic gain control algorithms implemented in the DSP 224.

The processor 240 operates under stored program control and executes software modules 221 stored in memory such as persistent memory, for example, in the flash memory 244. As illustrated in FIG. 10, the software modules 221 comprise operating system software 223 and software applications 225. Those skilled in the art will appreciate that the software modules 221 or parts thereof may be temporarily loaded into volatile memory such as the RAM 246. The RAM 246 is used for storing runtime data variables and other types of data or information, as will be apparent to those skilled in the art. Although specific functions are described for various types of memory, this is merely one example, and those skilled in the art will appreciate that a different assignment of functions to types of memory could also be used.

In some embodiments, the handheld electronic device 201 also includes a removable memory module or card 230 (typically comprising flash memory) and a memory card interface 232. Network access is typically associated with a subscriber or user of the handheld electronic device 201 via the memory card 230, which may be a Subscriber Identity Module (SIM) card for use in a GSM network or other type of memory card for use in the relevant wireless network type. The memory card 230 is inserted in or connected to the memory card interface 232 of the handheld electronic device 201 in order to operate in conjunction with the wireless network 103.

The handheld electronic device 201 stores data 227 in an erasable persistent memory, which in one example embodiment is the flash memory 244. In various embodiments, the data 227 includes service data comprising information required by the handheld electronic device 201 to establish and maintain communication with the wireless network 103. The data 227 may also include user application data such as email messages, address book and contact information, calendar and schedule information, notepad documents, image files, and other commonly stored user information stored on the handheld electronic device 201 by its user, and other data. The data 227 stored in the persistent memory (e.g. flash memory 244) of the handheld electronic device 201 may be organized, at least partially, into a number of databases each containing data items of the same data type or associated with the same application. For example, email messages, contact records, and task items may be stored in individual databases within the device memory.

The serial data port 252 may be used for synchronization with a user's host computer system (not shown). The serial data port 252 enables a user to set preferences through an external device or software application and extends the capabilities of the handheld electronic device 201 by providing for information or software downloads to the handheld electronic device 201 other than through the wireless network 103. The alternate download path may, for example, be used to load an encryption key onto the handheld electronic device 201 through a direct, reliable and trusted connection to thereby provide secure device communication.

In some embodiments, the handheld electronic device 201 is provided with a service routing application programming interface (API) which provides an application with the ability to route traffic through a serial data (i.e., USB) or Bluetooth® (Bluetooth® is a registered trademark of Bluetooth SIG, Inc.) connection to the host computer system using standard connectivity protocols. When a user connects their handheld electronic device 201 to the host computer system via a USB cable or Bluetooth® connection, traffic that was destined for the wireless network 103 is automatically routed to the handheld electronic device 201 using the USB cable or Bluetooth® connection. Similarly, any traffic destined for the wireless network 103 is automatically sent over the USB cable or Bluetooth® connection to the host computer system for processing.

The handheld electronic device 201 also includes a battery 238 as a power source, which is typically one or more rechargeable batteries that may be charged, for example, through charging circuitry coupled to a battery interface 236 such as the serial data port 252. The battery 238 provides electrical power to at least some of the electrical circuitry in the handheld electronic device 201, and the battery interface 236 provides a mechanical and electrical connection for the battery 238. The battery interface 236 is coupled to a regulator (not shown) which provides power V+ to the circuitry of the handheld electronic device 201.

The short-range communication subsystem 262 is an additional optional component which provides for communication between the handheld electronic device 201 and different systems or devices, which need not necessarily be similar devices. For example, the subsystem 262 may include an infrared device and associated circuits and components, or a wireless bus protocol compliant communication mechanism such as a Bluetooth® communication module to provide for communication with similarly-enabled systems and devices.

A predetermined set of applications that control basic device operations, including data and possibly voice communication applications will normally be installed on the handheld electronic device 201 during or after manufacture. Additional applications and/or upgrades to the operating system 221 or software applications 225 may also be loaded onto the handheld electronic device 201 through the wireless network 103, the auxiliary I/O subsystem 250, the serial port 252, the short-range communication subsystem 262, or other suitable subsystem 264. The downloaded programs or code modules may be permanently installed, for example, written into the program memory (i.e. the flash memory 244), or written into and executed from the RAM 246 for execution by the processor 240 at runtime. Such flexibility in application installation increases the functionality of the handheld electronic device 201 and may provide enhanced on-device functions, communication-related functions, or both. For example, secure communication applications may enable electronic commerce functions and other such financial transactions to be performed using the handheld electronic device 201.

The handheld electronic device 201 may provide two principal modes of communication: a data communication mode and an optional voice communication mode. In the data communication mode, a received data signal such as a text message, an email message, or Web page download will be processed by the communication subsystem 211 and input to the processor 240 for further processing. For example, a downloaded Web page may be further processed by a browser application or an email message may be processed by an email message messaging application and output to the display 204. A user of the handheld electronic device 201 may also compose data items, such as email messages, for example, using the input devices in conjunction with the display screen 204. These composed items may be transmitted through the communication subsystem 211 over the wireless network 103.

In the voice communication mode, the handheld electronic device 201 provides telephony functions and operates as a typical cellular phone. The overall operation is similar, except that the received signals would be output to the speaker 256 and signals for transmission would be generated by a transducer such as the microphone 258. The telephony functions are provided by a combination of software/firmware (i.e., the voice communication module) and hardware (i.e., the microphone 258, the speaker 256 and input devices). Alternative voice or audio I/O subsystems, such as a voice message recording subsystem, may also be implemented on the handheld electronic device 201. Although voice or audio signal output is typically accomplished primarily through the speaker 256, the display screen 204 may also be used to provide an indication of the identity of a calling party, duration of a voice call, or other voice call related information.

The various embodiments presented above are merely examples and are in no way meant to limit the scope of this disclosure. Variations of the embodiments described herein will be apparent to persons of ordinary skill in the art, such variations being within the intended scope of the present application. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A key assembly for use in an electronic device, comprising:

a plurality of dome switches;

one or more single-piece keycaps, each keycap having a plurality of key portions separated by deforming portions, each key portion being associated with a separate one of the plurality of dome switches;

a plurality of actuators for activating the dome switches, each actuator having a stem portion and an enlarged rigid blocking portion, the blocking portion being oriented on a side of the actuator which is proximate the dome switches and the stem portion being oriented on a side of the actuator which is proximate the keycaps; and one or more rigid blocking members disposed between the blocking portion of the actuators and the keycaps and in close proximity to the blocking portion of the actuators, the blocking members forming a barrier to limit a rotational movement of the actuators away from the dome switches.

2. The key assembly of claim 1, wherein the blocking members define openings through which the stem portion of the actuators are received, and wherein the blocking portion of the actuators are larger than the openings.

3. The key assembly of claim 1, wherein the one or more blocking members are comprised of a metal sheet.

4. The key assembly of claim 1, wherein the one or more blocking members define a plurality of openings for receiving the stem portion of the actuators.

5. The key assembly of claim 1, further comprising a movable portion connecting the stem portion to the blocking member, the movable portion being constructed of a deformable material to permit movement of the actuator towards the dome switches.

6. The key assembly of claim 1, wherein the blocking portion is held in close proximity to an interior side of the blocking member, and wherein an unbalanced force applied to the key portion associated with the actuator causes a blocking surface of the blocking portion of that actuator to interfere with the interior side of the blocking member to prevent the upward movement of the actuator.

7. The key assembly of claim 6 wherein an unbalanced force is a force which is applied to a single end of the key portion.

8. The key assembly of claim 7, wherein an unbalanced force occurs on a key portion when an external force is applied directly to an adjacent key portion of the same keycap.

9. The key assembly of claim 1, wherein each keycap identifies a row of keyboard characters.

10. The key assembly of claim 9, wherein the keyboard characters are the characters of a QWERTY keyboard.

11. An electronic device, comprising:

a controller for controlling the operation of the device; and a key assembly, comprising:

a plurality of dome switches;

one or more single-piece keycaps, each keycap having a plurality of key portions separated by deforming portions, each key portion being associated with a separate one of the plurality of dome switches;

a plurality of actuators for activating the dome switches, each actuator having a stem portion and an enlarged rigid blocking portion, the blocking portion being oriented on a side of the actuator which is proximate the dome switches and the stem portion being oriented on a side of the actuator which is proximate the keycaps; and one or more rigid blocking members disposed between the blocking portion of the actuators and the keycaps and in close proximity to the blocking portion of the actuators, the blocking members forming a barrier to limit a rotational movement of the actuators away from the dome switches.

12. The electronic device of claim 11, wherein the blocking members define openings through which the stem portion of the actuators are received, and wherein the blocking portion of the actuators are larger than the openings.

13. The electronic device of claim 11, wherein the one or more blocking members are comprised of a metal sheet.

14. The electronic device of claim 11, wherein the one or more blocking members define a plurality of openings for receiving the stem portion of the actuators.

15. The electronic device of claim 11, further comprising a movable portion connecting the stem portion to the blocking member, the movable portion being constructed of a deformable material to permit movement of the actuator towards the dome switches.

16. The electronic device of claim 11, wherein the blocking portion is held in close proximity to an interior side of the blocking member, and wherein an unbalanced force applied to the key portion associated with the actuator causes a blocking surface of the blocking portion of that actuator to interfere with the interior side of the blocking member to prevent the upward movement of the actuator.

17. The electronic device of claim 16 wherein an unbalanced force is a force which is applied to a single end of the key portion.

18. The electronic device of claim 17, wherein an unbalanced force occurs on a key portion when an external force is applied directly to an adjacent key portion of the same keycap.

19. The electronic device of claim 11, wherein each keycap identifies a row of keyboard characters.

20. The electronic device of claim 19, wherein the keyboard characters are the characters of a QWERTY keyboard.

* * * * *